US006520145B2

(12) United States Patent
Hunkert

(10) Patent No.: US 6,520,145 B2
(45) Date of Patent: Feb. 18, 2003

(54) FUEL INJECTION VALVE FOR INTERNAL COMBUSTION ENGINES

(75) Inventor: Steffen Hunkert, Sassenburg (DE)

(73) Assignee: Volkswagen AG, Wolfsburg (DE)

( * ) Notice: Subject to any disclaimer, the term of this patent is extended or adjusted under 35 U.S.C. 154(b) by 0 days.

(21) Appl. No.: 10/005,979

(22) Filed: Dec. 3, 2001

(65) Prior Publication Data

US 2002/0043574 A1 Apr. 18, 2002

Related U.S. Application Data

(63) Continuation of application No. PCT/EP00/04813, filed on May 26, 2000.

(30) Foreign Application Priority Data

Jun. 2, 1999 (DE) ..... 199 25 380

(51) Int. Cl.[7] ..... F02M 61/18
(52) U.S. Cl. ..... 123/305; 239/584; 239/533.12
(58) Field of Search ..... 123/299, 305; 239/533.2, 533.12, 533.4, 584

(56) References Cited

U.S. PATENT DOCUMENTS

| | | | |
|---|---|---|---|
| 4,069,978 | A | 1/1978 | El Moussa |
| 5,540,200 | A | 7/1996 | Naitoh et al. |

FOREIGN PATENT DOCUMENTS

| | | | |
|---|---|---|---|
| DE | 25 57 772 | | 6/1977 |
| DE | 197 15 505 | A1 | 11/1987 |
| DE | 42 22 137 | A1 | 1/1994 |
| DE | 196 42 513 | A1 | 4/1998 |
| EP | 0 352 926 | | 1/1990 |
| EP | 0 742 366 | A1 | 11/1996 |
| JP | 4-231676 | A | 12/1992 |

OTHER PUBLICATIONS

Yalcin H. et al.: "Konishe Einspritzlöcher eines Kraftstoffeinspritzventils für Brennkraftmaschinen" [conical injection holes of a fuel injection valve for internal combustion engines XP–000828544 Siemens Technik Report,, Year 2, No. 2, Jan. 1999.

*Primary Examiner*—Willis R. Wolfe
*Assistant Examiner*—Arnold Castro
(74) *Attorney, Agent, or Firm*—Laurence A. Greenberg; Werner H. Stemer; Ralph E. Locher

(57) ABSTRACT

A fuel injection valve for an internal combustion engine includes a valve body having a valve seat face. A valve member has a valve sealing face that interacts with the valve seat face for forming a sealing cross section. The valve member is displaceable along an axial direction in the valve body. The valve body has a wall with injection holes formed therein which are provided downstream of the sealing cross section as seen in a fuel flow direction. The injection holes are coneshaped injection holes and at least two of the injection holes have different cone angles.

7 Claims, 1 Drawing Sheet

FUEL INJECTION VALVE FOR INTERNAL COMBUSTION ENGINES

CROSS-REFERENCE TO RELATED APPLICATION

This application is a continuation of copending International Application No. PCT/EP00/04813, filed May 26, 2000, which designated the United States.

BACKGROUND OF THE INVENTION

FIELD OF THE INVENTION

The invention relates to a fuel injection valve for internal combustion engines.

Published European Patent Application No. EP 0 352 926 discloses a fuel injection valve having a piston-shaped valve member, which is axially displaceable in a valve body, and having a tapered valve sealing face at its end on the combustion chamber side. With the tapered valve sealing face the valve member interacts with a tapered valve seat face provided at a closed end of a bore in the valve body, a sealing cross section being formed at the line of contact between the valve sealing face and the valve seat face. Injection holes are provided downstream of the sealing cross section as seen in the fuel flow direction. These injection holes are provided in the wall of the valve body and extend from the bore in the valve body to the external cylindrical surface of the valve body and in so doing project into the combustion chamber of the internal combustion engine to be supplied with fuel. The injection holes of the fuel injection valve have a tapered form, the cross section of the injection holes tapering uniformly and conically from a relatively large diameter at the fuel inlet to a relatively small diameter at the fuel outlet.

A disadvantage of this conventional fuel injection valve is however that all injection holes have the same degree of taper of their conical shape, so that it is not possible to adjust the individual fuel injection jet at each injection hole separately to suit the respective requirements of the individual injection jet inside the combustion chamber. This individual optimization of the individual jet geometries at each injection hole is however of considerable importance, especially in the case of an eccentric or slanted installation position of the fuel injection valve in the combustion chamber of the internal combustion engine, since only by this individual optimization is it possible to optimize the fuel injection, in terms of the jet geometry and the jet preparation, to suit the respective conditions in the combustion chamber of the internal combustion engine, and thus to achieve optimum fuel preparation and combustion. Such optimization of the jet geometry at each jet entry into the combustion chamber is, however, not possible using the above-described fuel injection valve.

SUMMARY OF THE INVENTION

It is accordingly an object of the invention to provide a fuel injection valve which overcomes the above-mentioned disadvantages of the heretofore-known fuel injection valves of this general type and which allows an optimized injection of fuel.

With the foregoing and other objects in view there is provided, in accordance with the invention, a fuel injection valve for an internal combustion engine, including:

a valve body having a valve seat face provided thereon, the valve body defining an axial direction;

a valve member having an end region on a combustion chamber-side thereof and having a valve sealing.face in the end region, the valve sealing face interacting with the valve seat face of the valve body for forming a sealing cross section;

the valve member being displaceable along the axial direction in the valve body;

the valve body having a wall with injection holes formed therein, the injection holes being provided downstream from the sealing cross section as seen in a fuel flow direction; and the injection holes being cone-shaped injection holes, at least two of the injection holes having respectively different cone angles.

The fuel injection valve according to the invention, that is intended for internal combustion engines, has the advantage that at each injection hole it is possible to optimize the injection jet geometry or injection spray geometry as a function of the local requirements. For this purpose the injection holes have different angles of taper from one another, i.e. different angles of taper for the cone-shaped injection holes, by way of which the respective fuel flow and hence the injected fuel jet can be individually formed or shaped. In order to achieve this, it is possible to reduce the cross section of the injection hole uniformly from a large diameter to a small diameter in the direction of flow of the fuel. This is called a positive degree of taper or positive conical shape.

Alternatively, it is also possible, however, given corresponding requirements, to increase the cross section of the injection hole (spray hole) uniformly from the inlet aperture toward the outlet aperture on the combustion chamber side. This is called negative degree of (conical) taper.

According to an advantageous feature of the invention, at least two injection holes, depending upon the installation position of the fuel injection valve in the combustion chamber of the internal combustion engine to be supplied with fuel, have different angles of conical taper from one another. The angles of conical taper are preferably in a range between 10° and 90°.

According to another feature of the invention, it is particularly advantageous to increase the deflection angle (which is preferably between 15° and as much as 120° in exceptional installation cases) of the inlet fuel at the inlet into the injection hole, if the angle of taper is also increased, especially in the case of a positive conical taper.

According to another feature of the invention, a number of the injection holes are provided one over another along the axial direction.

According to yet another feature of the invention, the injection holes together with the wall of the valve body define respective deflection angles by which deflection angles the fuel flowing into the injection holes is deflected when entering the injection holes, and the cone angles are a function of the deflection angles such that given ones of the injection holes, which have substantially identical deflection angles, have substantially identical cone angles.

A plurality of injection holes may be provided on the fuel injection valve, wherein it is possible to provide the injection holes of varying configuration in a row around the circumference of the injection valve.

Alternatively, it is also possible, however, to provide a plurality of rows of injection holes, the rows being provided one over another, as seen in an axial direction, on the fuel injection valve, which can moreover be successively opened through corresponding actuation of the axially moveable valve member.

In addition, it is particularly advantageous for the fuel inlet flow into the injection hole if the inlet edges on the injection hole are radiused, i.e. the inlet edges are rounded off. This avoids swirling or turbulences at this point and thereby prevents the occurrence of regions of diminished pressure, so that the inlet fuel can flow evenly into the injection hole. This measure also assists in forming the fuel flow inside the injection hole into the desired geometry of the injected fuel jet at the outlet of the injection hole.

With the fuel injection valve according to the invention for internal combustion engines it is therefore possible to advantageously provide each individual injection hole with an individual, optimized degree of taper according to the required fuel flow and jet geometry at the outlet, whilst the angle of taper of the corresponding injection hole may be either positive or negative. An optimized, individual configuring of the angle of taper at the individual injection holes thus means that the same mean velocity of fuel flow can be produced at each spray hole outlet, despite the differing deflection angle of the inlet fuel and a slanted installation position of the fuel injection valve in the combustion chamber.

Other features which are considered as characteristic for the invention are set forth in the appended claims.

Although the invention is illustrated and described herein as embodied in a fuel injection valve for internal combustion engines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
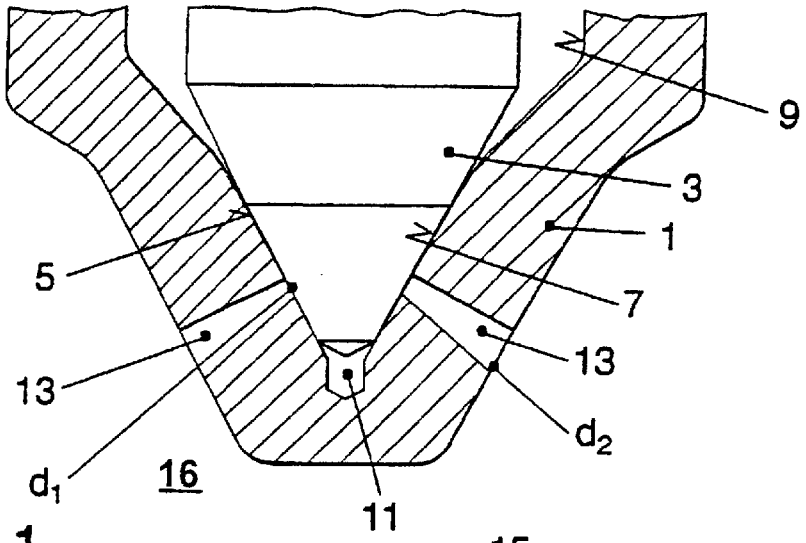
FIG. 1 is a diagrammatic, partial sectional view of the combustion chamber-side tip of a first exemplary embodiment of the fuel injection valve according to the invention, in which the injection holes have a negative angle of taper.

Referring now to the figures of the drawings in detail and first, particularly, to FIG. 1 thereof, there is shown the first exemplary embodiment of the fuel injection valve for internal combustion engines according to the invention only that region of the fuel injection valve that is essential for the invention is represented in FIG. 1. The fuel injection valve has a valve body 1 whose bottom end is shown in FIG. 1. The bottom end of the valve body 1 projects into a combustion chamber region 16 of an internal combustion engine. A valve member 3 has a tapered, i.e. conical, valve sealing face 5 at its bottom end at the side of the combustion chamber end. The valve member 3 interacts with its valve sealing face 5 with a valve seat face 7 on the valve body 1. The valve member 3 is guided such that it is displaceable in the valve body 1 along an axial direction. The valve seat face 7 is formed at a closed end of a bore 9 in the valve body 1 and likewise has a conically tapered cross section, the angle of taper of the valve seat face 7 differing slightly from the angle of taper of the valve sealing face 5 on the valve member 3. The difference in the angles of taper between the valve seat face 7 and valve sealing face 5 provides a circumferential line contact. The circumferential line contact forms a sealing cross section which, when the valve member 3 bears on the valve seat face 7, separates a space of the bore 9 situated upstream (as seen in the direction of fuel flow) from a blind hole 11 at the closed end of the bore 9 that is situated downstream. In addition a plurality of injection holes 13 are provided in the valve body 1, which proceeding from the wall of the bore 9 open onto the external peripheral surface of the valve body 1 and in so doing project into the combustion chamber 16 of the internal combustion engine to be supplied with fuel. The injection holes are to be of conical shape according to the required fuel flow and the required injection jet to be discharged. The first exemplary embodiment represented in FIG. 1 is shown with a negative conical taper, in which the angle of taper is selected in such a way that the cross section of the injection hole increases continuously in the direction of flow of the fuel from a relatively small inlet diameter at the wall of the bore 9 to a larger outlet diameter at the external peripheral wall of the valve body 1. Here, at least two of the injection holes 13 are to have different angles of conical taper from one another. The angles will be dependent upon the position of the respective injection hole in the valve body 1 and the positioning of the entire fuel injection valve in the combustion chamber of the internal combustion engine to be supplied with fuel.

Figure 2:
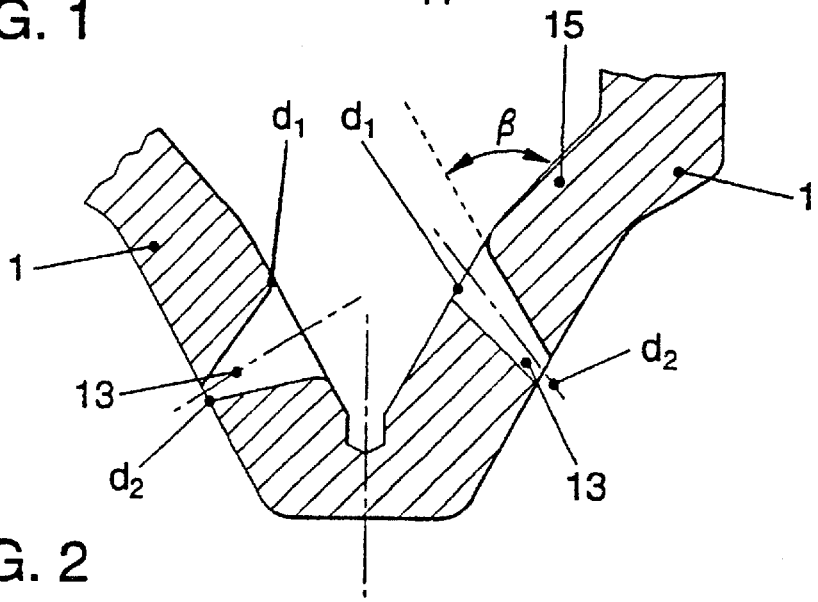
FIG. 2 is a diagrammatic, partial sectional view of the combustion chamber-side part of the valve body of a second exemplary embodiment of the fuel injection valve according to the invention, in which the adjacent injection holes are staggered and have different positive angles of taper.

The second exemplary embodiment of the fuel injection valve according to the invention shown in FIG. 2 differs from the first exemplary embodiment shown in FIG. 1 in terms of the positioning and configuration of the injection holes 13 in the wall of the valve body 1. In this case the injection holes 13 now have a positive conical taper, in which the diameter d1 at the inlet into the injection hole 13 is formed to be larger than the diameter d2 at the outlet aperture of the injection hole 13 into the combustion chamber of the internal combustion engine to be supplied with fuel. In the second exemplary embodiment two injection holes 13 are provided, which are differently positioned in the valve body 1 and which moreover have different angles of conical taper. In this case the angle of taper or cone angle $\alpha$ varies as a function of the deflection angle $\beta$ of the fuel flowing in at the inlet into the injection hole 13. The angle of taper $\alpha$ at the injection holes 13 should likewise preferably increase as the deflection angle $\beta$ increases.

In addition, the inlet edges 15 at the transition between the internal wall surface of the valve body 1 and the inlet into the injection hole 13 are radiused, i.e. the inlet edges are rounded. In this way a uniform fuel inlet flow into the injection holes 13 can be achieved. The fuel inlet flow can then be formed into a desired injection jet pattern by configuring the angle of conical taper inside the injection holes 13 in accordance with a desired fuel jet pattern.

Figure 3:
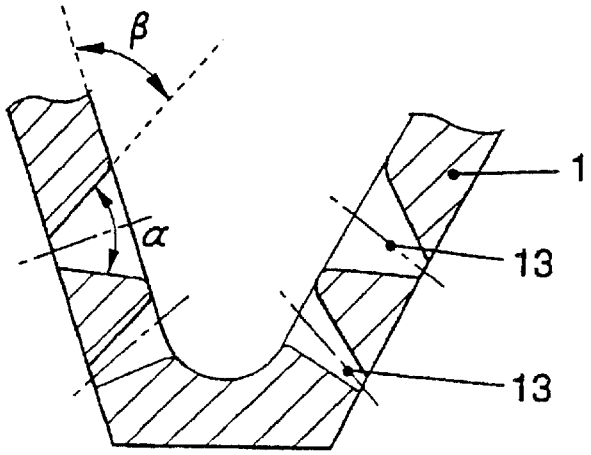
FIG. 3 is a diagrammatic, partial sectional view of the combustion chamber-side part of the valve body of a third exemplary embodiment of the fuel injection valve according to the invention with two rows of injection holes having different angles of taper, the two rows being provided one over the other along the axial direction.

FIG. 3 shows a third exemplary embodiment of the fuel injection valve according to the invention for internal combustion engines, in which two rows of injection holes 13 provided axially one above the other are now provided in the valve body 1. In this case injection holes 13 are circumferentially disposed in series with each of the injection holes in one circle having the same deflection angle β and hence the same angle of taper or cone angle α.

Alternatively, in addition to the three exemplary embodiments shown, all combinations of tapered injection holes or spray holes are possible, wherein it is possible to optimize the individual injection hole geometry according to the required fuel flow and the required jet geometry at the injection outlet.

I claim:

1. A fuel injection valve for an internal combustion engine, comprising:

a valve body having a valve seat face provided thereon, said valve body defining an axial direction;

a valve member having an end region on a combustion chamber-side thereof and having a valve sealing face in said end region, said valve sealing face interacting with said valve seat face of said valve body for forming a sealing cross section;

said valve member being displaceable along the axial direction in said valve body;

said valve body having a wall with injection holes formed therein, said injection holes being provided downstream from said sealing cross section as seen in a fuel flow direction; and said injection holes being cone-shaped injection holes, at least two of said injection holes having respectively different cone angles.

2. The fuel injection valve according to claim 1, wherein:

said wall of said valve body has an inner wall surface and has an outer wall surface configured to project into a combustion chamber of the internal combustion engine;

said injection holes have a respective inlet diameter at said inner wall surface and a respective outlet diameter at said outer wall surface; and said respective inlet diameter is smaller than said respective outlet diameter.

3. The fuel injection valve according to claim 1, wherein:

said wall of said valve body has an inner wall surface and has an outer wall surface configured to project into a combustion chamber of the internal combustion engine;

said injection holes have a respective inlet diameter at said inner wall surface and a respective outlet diameter at said outer wall surface; and said respective inlet diameter is larger than said respective outlet diameter.

4. The fuel injection valve according to claim 1, wherein a first one of said injection holes is provided over a second one of said injection holes along the axial direction.

5. The fuel injection valve according to claim 1, wherein:

said injection holes together with said wall of said valve body define respective deflection angles by which fuel flowing into said injection holes is deflected when entering said injection holes; and said cone angles are a function of said deflection angles such that given ones of said injection holes, which have substantially identical deflection angles, have substantially identical cone angles.

6. The fuel injection valve according to claim 1, wherein:

said injection holes together with said wall of said valve body define respective deflection angles by which fuel flowing into said injection holes is deflected when entering said injection holes; and said valve body is configured such that said deflection angles are relatively larger for relatively larger ones of said cone angles and are relatively smaller for relatively smaller ones of said cone angles.

7. The fuel injection valve according to claim 1, wherein:

said wall of said valve body has an inner wall surface and is formed with inlet edges at transitions between said inner wall surface and said injection holes; and said inlet edges are rounded edges.

* * * * *